United States Patent [19]

Schmid

[11] 4,068,845

[45] Jan. 17, 1978

[54] BOWLING PIN POSITIONING APPARATUS

[75] Inventor: August Schmid, Schwerzenbach, Switzerland

[73] Assignee: Patentverwertungs-und Finanzierungsgesellschaft, Serania AG, Glarus, Switzerland

[21] Appl. No.: 685,308

[22] Filed: May 11, 1976

[30] Foreign Application Priority Data

May 30, 1975 Switzerland ..... 6982/75

[51] Int. Cl.[2] ..... A63D 5/08

[52] U.S. Cl. ..... 273/42 A; 188/289

[58] Field of Search ..... 273/42 A, 43 A; 188/289

[56] References Cited

U.S. PATENT DOCUMENTS

| | | | |
|---|---|---|---|
| 1,584,030 | 5/1926 | Gray | 273/42 A |
| 2,671,536 | 3/1954 | Jurasevich | 188/289 |
| 2,736,554 | 2/1956 | Fluke et al. | 273/43 A |
| 2,879,997 | 3/1959 | Black et al. | 273/43 A |
| 3,456,764 | 7/1969 | Myers | 188/289 |
| 3,809,398 | 5/1974 | Schmid et al. | 273/43 A |

*Primary Examiner*—Anton O. Oechsle

*Attorney, Agent, or Firm*—Flynn & Frishauf

[57] ABSTRACT

A frame is vertically movable, the frame being arranged to carry out a full stroke to pick up still standing bowling pins and a partial stroke to place pins on the surface of a bowling alley; to control the length of the stroke, and provide for soft stopping of the frame at the terminal end of its stroke, a stroke control and limit lever is selectively positionable in interfering relation with respect to the downward movement of the frame. The interference position of the control and limit lever is externally controllable, for example by a electromagnet or solenoid, the lever being further connected to a hydraulic dashpot. When in interfering position, the frame, upon its downward stroke, impinges on the control and limit lever which can deflect, the dashpot gradually braking the downward movement until the deflection limit of the limit lever is reached, for example at the end position of the dashpot.

7 Claims, 2 Drawing Figures

BOWLING PIN POSITIONING APPARATUS

Figure 1:
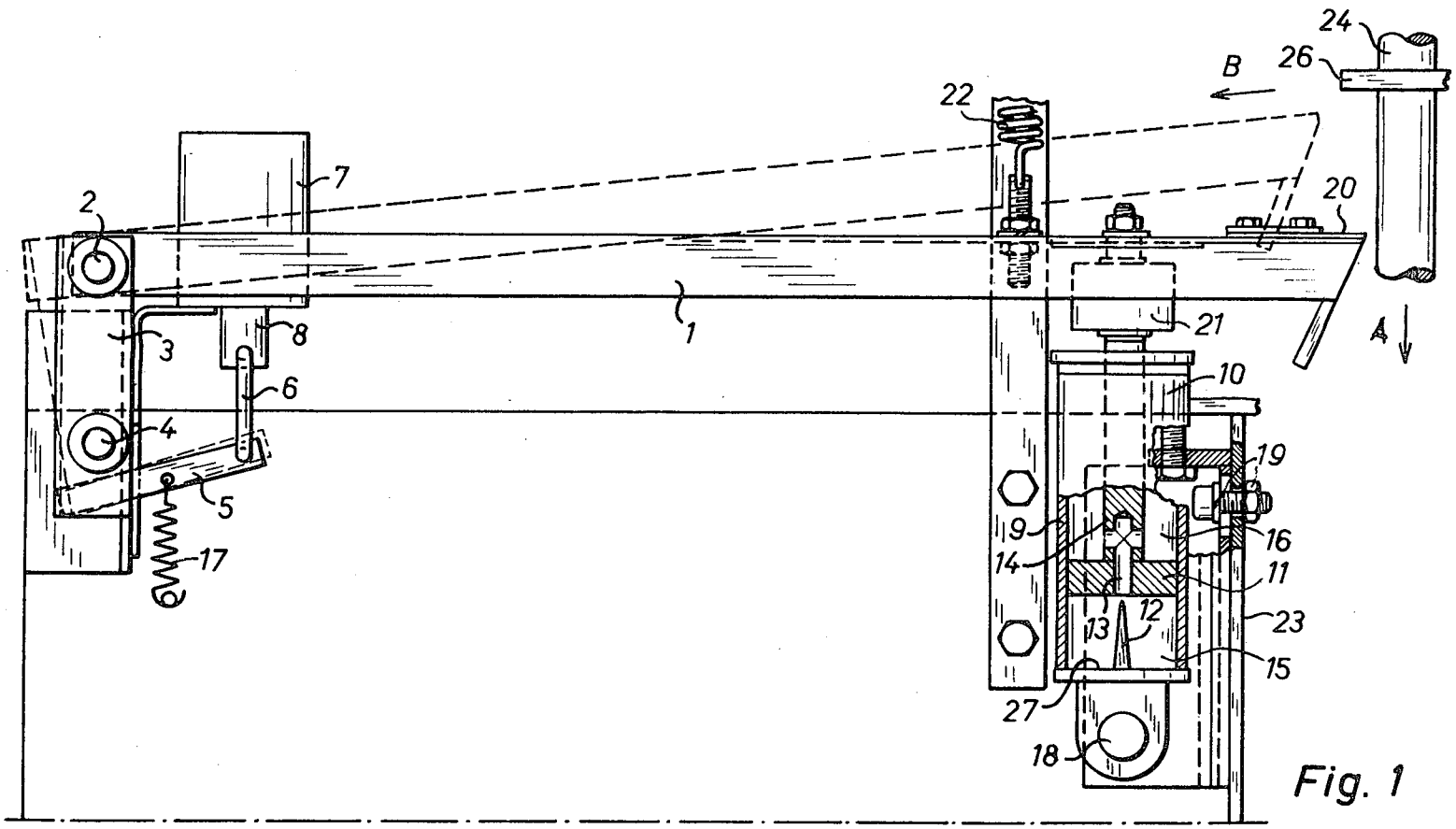

Cross reference to related patents: U.S. Pat. Nos. 3,809,398; 3,809,400; 3,810,617, all by the inventor hereof and all assigned to the assignee of the present application.

The present invention relates to a bowling pin positioning arrangement or apparatus, in which a frame is vertically movable to receive bowling pins which are standing and reposition the so standing bowling pins.

In the "bowling" game, the rules provide that a player plays two sequential balls. The pins which fell after the first ball are removed from the alley; the second ball is then played to knock down those pins which were left standing after playing the first ball. Automatic bowling pin spotting apparatus in which the pins are not suspended from cables or ropes customarily pick up those pins which are left standing after the first ball has been played and lift them off the bowling alley. A sweeper blade then sweeps the fallen pins into a pit; the pins which had been left standing after playing the first ball are then repositioned in their previous locations.

Apparatus capable of carrying out this arrangement, so that the rules of the game can be observed, may use a movable frame to both pick up the still standing bowling pins; this sequence of movement requires a stroke through two different heights — for one, when placing bowling pins, which requires a long stroke; and for the other, to pick up still standing pins, a stroke which is less long and terminates upwardly of the placing position of the frame. The frame, therefore, thus must move with respect to the surface of the bowling alley alternately with a full stroke, or with a partial stroke.

It might appear obvious to control the length of the stroke, that is, the length of movement of the frame by controlling the drive motor which operates the frame for different time periods by means of an electrical or electronic control. It has been found that this is impractical, since the overrun of an electric motor, particularly when combined with step-down gearing and other transmission elements, is highly dependent on extraneous influences, principally friction. The stopping position of the motor, upon a partial stroke, thus is not sufficiently accurate. Additionally, stopping the frame at the end of the partial stroke should occur gradually, that is, the stop should not be abrupt or sudden but the frame should, rather, slide to a gradual, smooth and gentle stop without shock, impact or vibration.

It is an object of the present invention to provide an arrangement and apparatus which permits differential length of stroke of a frame of bowling pin spotting apparatus which places the frame in an intermediate position by gradually stopping the frame so it will come to a gentle stop, and which, additionally, is simple and reliable and easily controllable.

Subject matter of the present invention: Briefly, a control and limit lever, which can be placed selectively in interfering position with respect to the frame or an element thereof, is provided, the specific position of the control or limit lever, that is, whether in interfering or non-interfering position, being externally controllable, for example by an electromagent. A damping arrangement such as a hydraulic dashpot is operatively connected to the control or limit lever. If the control or limit lever is set in interfering position, the frame or an element carrying an abutment thereof engages the control or limit lever which will deflect and engage the dashpot. The control and limit lever has a limiting position which, when reached, will support the frame at a position intermediate its total stroke. If the control and limit lever is moved out of interfering position, the stroke of the frame, as controlled by its mechanism, can be carried to its full length.

The arrangement is simple and does not use means or elements subject to trouble or malfunction. It is a simple matter to select the stroke by positioning the control and limit lever. The arrangement permits a precise and gentle stopping of the frame in a position intermediate its full stroke. The elements needed therefor are few in number and simple to manufacture or standard articles of trade.

Figure 2:
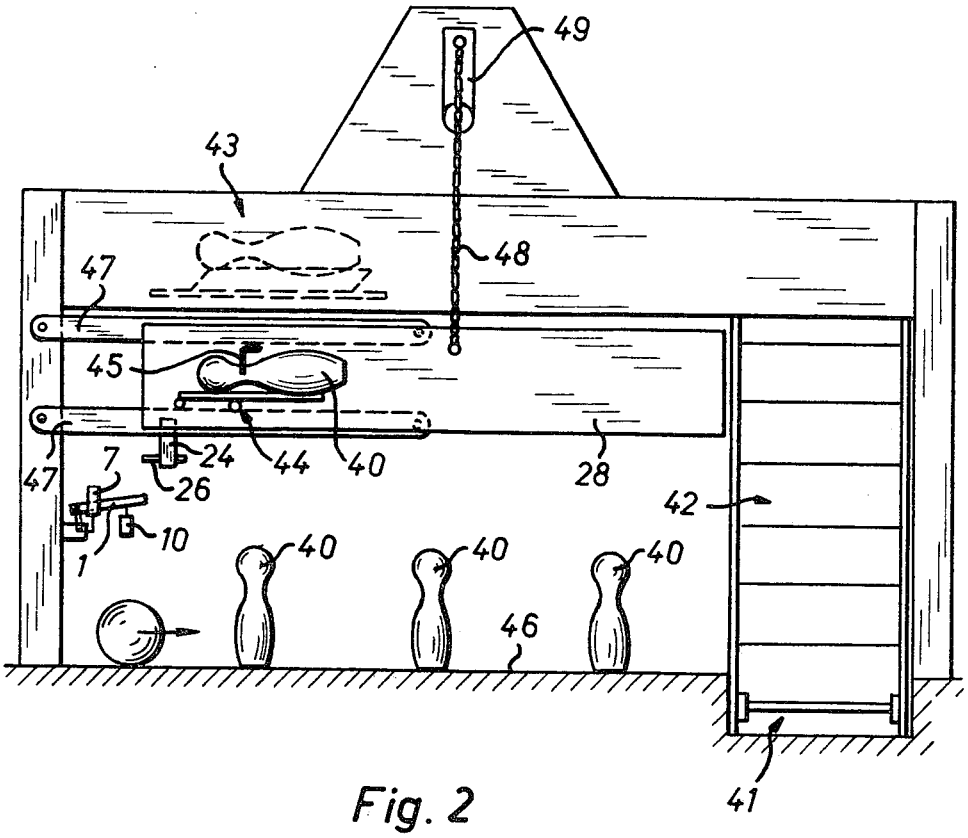

The invention will be described by way of example with reference to the accompanying drawings, wherein:

FIG. 1 is a side view of the limiting arrangement for the positioning apparatus, partly in section; and FIG. 2 is a schematic front view of a bowling pin positioning apparatus incorporating the stroke limiting arrangement shown in greater detail in FIG. 1.

The bowling pin positioning apparatus operates with bowling pins 40 which are free, that is, they are not suspended from holding cables or ropes. Bowling pins which have been knocked down by a bowling ball are swept into a pit 41 by a sweeper or wiper (not shown) to be lifted thereafter by an elevator 42 and distributed through a bowling pin distribution apparatus 43 which guides the pins to a vertically movable frame 28. A suitable sweeper apparatus is disclosed in U.S. Pat. No. 3,809,400; a suitable pin distribution arrangement 43 is shown in U.S. Pat. No. 3,801,617. The frame 28 has pivotable baskets 44 which, in the upper position of the frame 28, are horizontal; during the vertical movement of the frame 28, baskets 44, including bowling pins 40 therein, pivot to vertical position. U.S. Pat. No. 3,809,398, by the inventor hereof, discloses this arrangement in detail, and reference is hereby made thereto. The pins 40 are held in the baskets 44 by rotatable flaps 45. Flaps 45 are released when the pins 40 are to be placed on the bowling alley surface 46.

Frame 28 additionally is supplied with grippers (not shown) at positions differing from the locations of the flaps 45 in order to lift pins 40 which have remained after the first ball has been played. Frame 28 is guided in a parallelogram linkage 47, so that it operates parallel to itself in its vertical up-and-down movement.

Depending upon whether the pins 40 are to be positioned on the alley surface 46, or if pins which remained after the first playing of the ball were to be picked up, frame 28 must carry out a vertical movement which differs in stroke. To pick up the still remaining pins, only a partial stroke, that is, a vertical movement through only a part of the total movement, is needed.

Frame 28 has a vertical rod 24 (FIGS. 1, 2) attached thereto, on which a collar 26 is secured. The collar 26 may be vertically adjustable on rod 24 to adjust the length of the limited stroke. Rod 24 with its collar 28 moves in a downward direction along arrow A when the frame 28 is lowered. The shoulder 26 cooperates with a stroke control and limiting lever 1, seen in side view in FIG. 2, is journalled to pivot about a bolt 2. Bolt 2 is retained in a double-armed lever 3. Lever 3 can pivot about a pivot axis 4, which is secured to the support frame of the apparatus in fixed position. The lower end of lever 3 has a link 5 rigidly secured thereto. Link 5 can be raised when a solenoid coil 7 is energized to pull up an armature 8, connected by link 6 to link 5. A spring 17 exerts a downwardly pulling force on the link 5, so that the armature 8 normally is pulled downwardly.

The other end of lever 1 has a spring 22 attached thereto which tends to pull lever 1 upwardly. The end of the spring 22 not shown in the drawings is secured to the frame.

A progressively acting damping arrangement lever 10 engages if lever 1 tends to move downwardly. Damping arrangement 10 is secured by one or more attachment screws 19 to a stationary portion 23 of the frame structure of the apparatus. The damping arrangement 10 includes an approximately vertically located cylinder 9 in which a piston 11 is axially movably located. A piston rod 14 connected to piston 9 is attached, through a rubber bumper 21, to the lever 1. The lower end of the cylinder 9 is movable, and held in position by a bearing 18. The piston 11 subdivides the inner space of the cylinder 9 into lower and upper chambers 15, 16. The chambers are filled with hydraulic fluid, such as hydraulic oil. The chambers can communicate by a relatively narrow opening 13 formed in the piston 11 and in the piston rod, as seen in FIG. 1. The bottom wall 27 of the lower chamber 15 has a pointed cone 12 secured thereto which, if piston 11 moves downwardly, fits into the flow opening 13 and causes increasing constriction of the gap between the opening 13 and the pin 12. Pin 12 is conical, so that the flow of hydraulic fluid through the opening 13 is progressively throttled as the piston 11 moves downwardly. In its lower position, piston 11 engages the bottom wall 27 of the lower chamber 15.

Operation: The lever 1 can be placed in interfering position with respect to the frame 28 or, rather, with respect to collar 26 on rod 24 in dependence on energization of solenoid coil 7. If solenoid 7 is energized, the lever 1 is moved in the direction of arrow B (FIG. 1) to pull the lever beyond the range of movement of the collar 26 upon downward movement of rod 24 together with frame 28. If the magnet 7 is not energized, the collar 26 will impinge on an abutment plate 20 on lever 1.

Let is be assumed that solenoid 7 is not energized; collar 26 of rod 24 secured to frame 28 will engage the forward end of lever 1. Downward movement of the frame 28 is damped only slightly since the oil in the lower chamber of the cylinder 9 can rapidly flow through the opening 13 to reach the upper chamber 16. Upon continued downward movement, the conical pin 12 increasingly constricts the cross-sectional area available for flow through opening 13, thus choking the flow of oil. Downward movement of the frame 28 is increasingly damped as the frame 28 approaches the bottom 27 of chamber 15. This effect gradual and gentle braking, and finally stopping of the frame 28 to which the rod 24 is secured, even if frame 28 has a substantial weight and drops with relatively high speed. Upon subsequent upward movement of rod 24, spring 22 tends to pull the lever 1 upwardly into its initial position.

If electromagnet on solenid 7 is energized before the dropping cycle of frame 28 has commenced, lever 1 is moved to the left in direction of arrow B (FIG. 1) so that it will assume the position shown in broken lines. Shoulder 26 can now pass past the end plate 20 of lever 1, and frame 28 can move through its full stroke to drop pins secured therein.

Frame 28 is suspended at both sides by a chain; only one chain 48 is visible in FIG. 2. The chain 48 is connected to a crank 49 which, upon one complete rotation, moves the frame 28 through a full operating cycle. If the frame 28 should carry out only a partial stroke, crank 29 can still rotate through a full revolution, since chain 48 will merely remain slack for a portion of the rotation of the crank 49. Chain 48, then, does not support the frame which, rather, will be supported by engagement of collar 26 with lever 1 which, in turn, is supported by the piston rod and the piston 11 on the bottom 27 of cylinder 9. Thus, no modification of the raising-lowering suspension by chain 48 in crank 49 is necessary, while still permitting control of the length of the stroke of movement of frame 28 in dependence on selective energization of solenoid 7.

In a preferred form, two stroke limiting arrangements are placed on respective sides of the frame 28 in order to prevent distortion of the frame by non-symmetrical support at one side only if the stroke is limited. Depending on the relative weights, however, and the guiding arrangements, only one such stroke limiting arrangement may be necessary.

Various changes and modifications may be made within the scope of the inventive concept.

I claim:

1. Bowling pin positioning arrangement having a vertically movable frame (28) adapted to receive and place bowling pins (40) on the surface (46) of a bowling alley;

means (48, 49) coupled to the frame moving the frame downwardly and upwardly through a stroke extending between top and bottom limiting position comprising a crank arm (49) and a chain (48) supporting the frame (28) and, upon rotation of the crank arm, suspending the frame (28) for vertical movement;

and a stroke limiting means to decrease the length of the stroke of movement in downward direction including an abutment element (26) secured to said frame, a movable control and limit level (1) selectively positionable in interfering or non-interfering relation with respect to the abutment element (26) to control movement of the frame (28), said abutment element (26) being supported by the control and limit lever (1) when in interfering position to, in turn, support said frame;

an electromagnet (7) coupled to and moving the control and limit lever (1) between interfering and non-interfering in dependence on respective energization or non-energization of the electromagnet;

said chain (48) suspending the frame (28) when the frame carries out a full stroke and being slack for a portion of the stroke if the control and limit lever is selectively positioned in interfering relationship with respect to the abutment element, and hence the frame (28) during a complete rotation of the crank (49), to control the stroke length of the frame (28) independently of the rotation of the crank (49);

and a damping dashpot (10) operably connected to the control and limit lever (1) to dampen movement of the frame (28) when the limit lever (1) is positioned in interfering relation with respect to the movement of the frame (28), said dashpot being a hydraulic dashpot (10) and comprising a cylinder-piston combination (9, 11), the piston being formed with a fluid passage (13) therethrough, the piston (11) subdividing the cylinder (9) into two chambers (15, 16)

and a conical pin (13) located within the cylinder (9) and in alignment with the fluid passage (13), located in position to penetrate the fluid passage upon movement of the piston (11) in the cylinder to decrease the cross-sectional flow area available for fluid flow from one chamber into the other through said fluid passage (13) thereby progressively throttling said fluid flow and increasingly braking movement of said limit lever and hence of the frame (28), the piston (11) engaging the bottom wall (27) of the lower chamber (15) of the dashpot when the piston (11) reaches its limiting position to support the piston, and hence to control and limit lever (1) and thereby the frame (28) if the control and limit lever was in interfering position with respect to the frame.

2. Arrangement according to claim 1, wherein the cylinder-piston arrangement is pivotably supported to swing or rock about an axis transverse to the direction of movement between the cylinder and piston.

3. Arrangement according to claim 1, wherein the control and limit lever comprises a projecting lever element (1), a double-armed link lever (3) being pivoted to said limit lever (1) and supporting said limit lever, the doublearmed link lever being rotatable about a pivot axis remote from the connection (2) between the link lever (3) and the control and limit lever (1) so that, upon movement of the link lever (3), the control and limit lever may carry out a pivotal as well as a translatory movement with respect to the support axis of the link lever (3).

4. Arrangement according to claim 1, wherein the frame (28) is essentially rectangular in plan and means (47) are provided guiding said frame for essentially vertical movement transverse to the major plane of the rectangle;

and wherein two control and limit levers and two dashpots are provided, located at respectively opposite sides of the frame and positioned to support the frame symmetrically when the control and limit lever (1) is moved in interfering position.

5. Arrangement according to claim 1, further comprising a double-armed link lever (3) pivotable about an axis remote from one end of one arm of the link lever, the said end of the arm of the link lever being connected to the control and limit lever, said link lever (1) (3) being moved, selectively, by said electromagnet (7) in dependence on energization thereof, movement of said link lever effecting both pivotal as well as translatory movement of the control and limit lever.

6. Arrangement according to claim 5, wherein the means (48, 49) coupled to the frame (28) and moving the frame in a vertical direction comprises a crank arm (49) and a chain (48) supporting the frame (28) and, upon rotation of the crank arm, suspending the frame for vertical movement;

said chain (48) suspending the frame (28) when the frame carries out a full stroke and being slack for a portion of the stroke if the control and limit lever is selectively positioned in interfering relationship with respect to the frame (28) during a complete rotation of the crank (49), to control the stroke length of the frame (28) independently of the rotation of the crank (49).

7. Arrangement according to claim 1, wherein the damping dash-pot (10) is positioned approximately vertically.

* * * * *